United States Patent [19]

Mandel et al.

[11] 4,248,327

[45] Feb. 3, 1981

[54] ELEVATOR SYSTEM

[75] Inventors: Alan F. Mandel, Pittsburgh, Pa.; Louis M. Capuano, Westfield, N.J.; Paul R. Otto, Santa Ana, Calif.; Kenneth M. Eichler, North Versailles, Pa.

[73] Assignee: Westinghouse Electric Corp., Pittsburgh, Pa.

[21] Appl. No.: 21,655

[22] Filed: Mar. 19, 1979

[51] Int. Cl.[3] ..... B66B 3/00

[52] U.S. Cl. ..... 187/29 R; 340/19 R

[58] Field of Search ..... 187/29; 340/19-21

[56] References Cited

U.S. PATENT DOCUMENTS

| | | | |
|---|---|---|---|
| 3,740,709 | 6/1973 | Savino | 340/21 |
| 3,973,648 | 8/1976 | Hummert et al. | 340/19 R X |
| 4,082,164 | 4/1978 | Sackin et al. | 187/29 R |
| 4,106,593 | 8/1978 | Otto et al. | 340/19 R X |
| 4,149,614 | 4/1979 | Mandel et al. | 340/19 R X |
| 4,157,133 | 6/1979 | Corcoran et al. | 187/29 R |

*Primary Examiner*—Gene Z. Rubinson
*Assistant Examiner*—W. E. Duncanson, Jr.
*Attorney, Agent, or Firm*—D. R. Lackey

[57] ABSTRACT

An elevator system including at least one elevator car mounted for movement in a building to serve the floors therein, and pushbuttons for entering calls for elevator service. Calls for elevator service initiated by the pushbuttons are sequentially displayed in a predetermined order on a display, which also displays the total number of unanswered calls in the system at any instant. In a preferred embodiment, the predetermined order sequentially displays the calls starting with the call associated with the lowest floor, and proceeding upwardly through the building to the highest floor of the building.

6 Claims, 14 Drawing Figures

FIG. 2
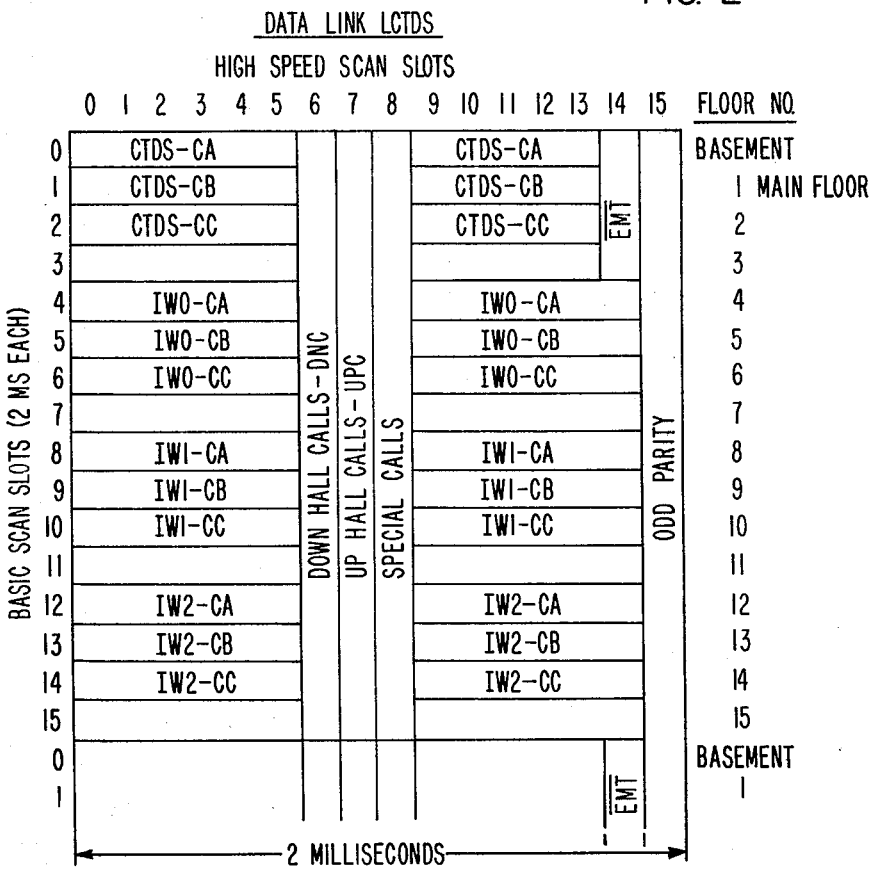
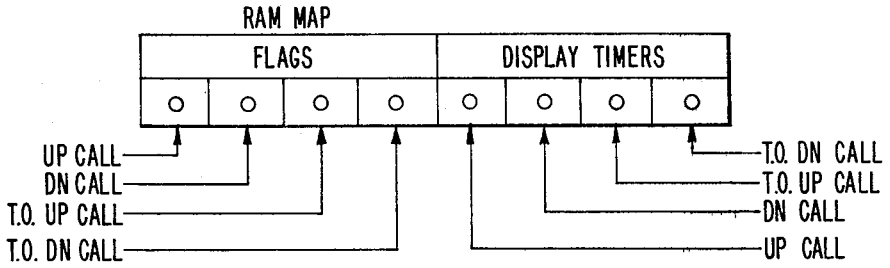
FIG. 11

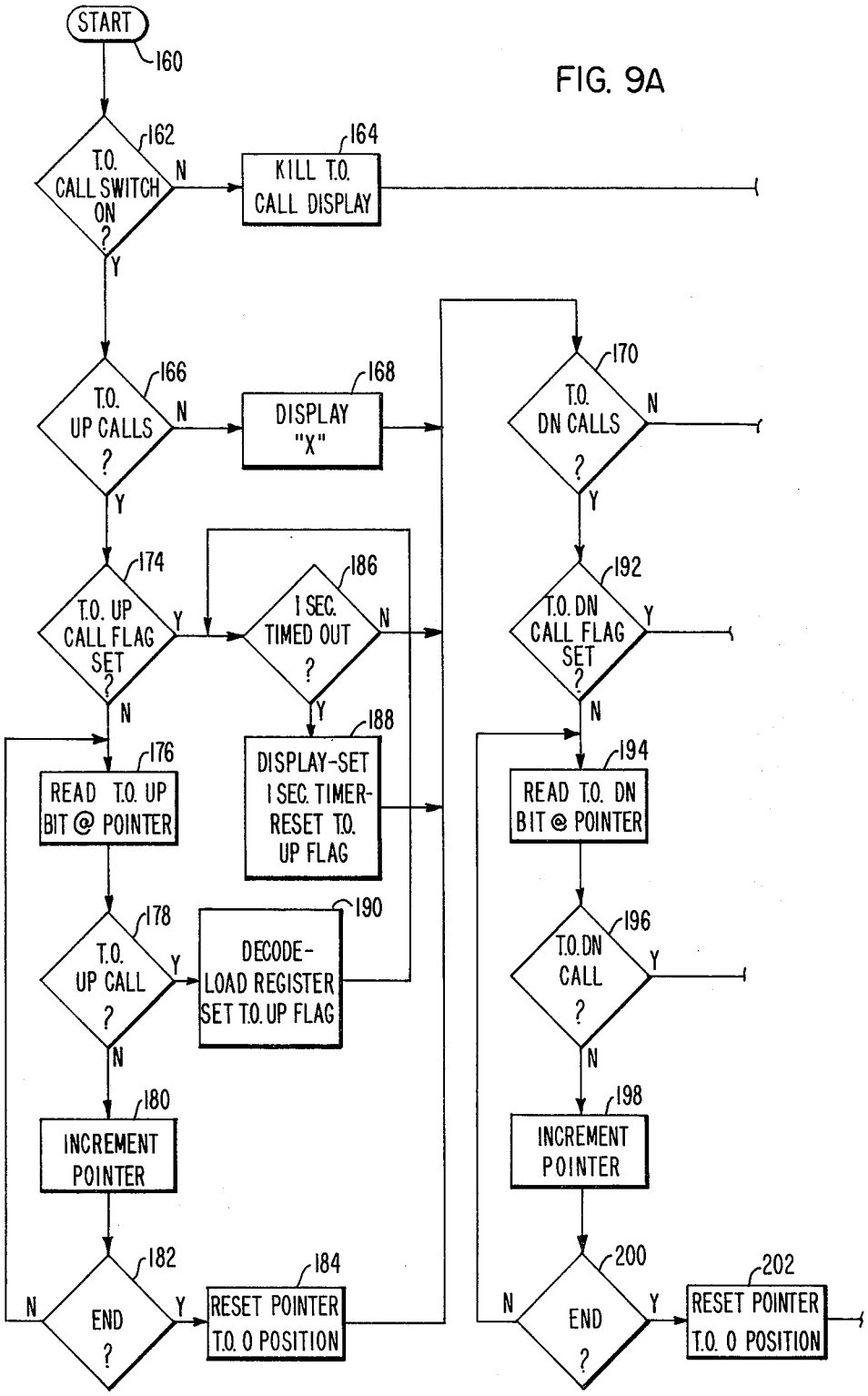
START
160
FIG. 9A
162
T.O. CALL SWITCH ON ?
N
164
KILL T.O. CALL DISPLAY
Y
166
T.O. UP CALLS ?
N
168
DISPLAY "X"
Y
170
T.O. DN CALLS ?
N
Y
174
T.O. UP CALL FLAG SET ?
Y
186
1 SEC. TIMED OUT ?
N
Y
188
DISPLAY-SET 1 SEC. TIMER-RESET T.O. UP FLAG
N
176
READ T.O. UP BIT @ POINTER
178
T.O. UP CALL ?
Y
190
DECODE-LOAD REGISTER SET T.O. UP FLAG
N
180
INCREMENT POINTER
182
END ?
N
Y
184
RESET POINTER T.O. 0 POSITION
192
T.O. DN CALL FLAG SET ?
Y
N
194
READ T.O. DN BIT @ POINTER
196
T.O. DN CALL ?
Y
N
198
INCREMENT POINTER
200
END ?
N
Y
202
RESET POINTER T.O. 0 POSITION

| ROM MAP | | RAM MAP | | | | | | | | | | | | | | | | | | | |
|---|---|---|---|---|---|---|---|---|---|---|---|---|---|---|---|---|---|---|---|---|---|
| LOOK UP TABLE | | HALL CALLS | | TIMED HALL CALLS | | | | | | | | | | | | | | | | | |
| SCAN SLOT | FLOOR | UP | DOWN | UP | TIMER | | | | | | | | DN | TIMER | | | | | | | |
| 15 | 15 | 0 | 0 | | | | | | | | | | | | | | | | | | |
| 14 | 14 | 0 | 0 | | | | | | | | | | | | | | | | | | |
| 13 | 13 | 0 | 0 | | | | | | | | | | | | | | | | | | |
| 12 | 12 | 0 | 0 | | | | | | | | | | | | | | | | | | |
| 11 | 11 | 1 | 1 | 1 | 0 | 0 | 0 | 1 | 1 | 1 | 1 | 0 | 1 | 0 | 0 | 1 | 1 | 1 | 0 | 0 | 1 |
| 10 | 10 | 1 | 0 | 1 | 0 | 0 | 1 | 0 | 0 | 0 | 0 | 1 | | | | | | | | | |
| 9 | 9 | 0 | 0 | | | | | | | | | | | | | | | | | | |
| 8 | 8 | 0 | 0 | | | | | | | | | | | | | | | | | | |
| 7 | 7 | 0 | 0 | | | | | | | | | | | | | | | | | | |
| 6 | 6 | 0 | 1 | | | | | | | | | | 1 | 0 | 0 | 0 | 1 | 1 | 1 | 0 | 0 |
| 5 | 5 | 0 | 1 | | | | | | | | | | 1 | 0 | 0 | 0 | 0 | 1 | 1 | 0 | 0 |
| 4 | 4 | 0 | 1 | | | | | | | | | | 1 | 0 | 0 | 0 | 0 | 0 | 0 | 0 | 0 |
| 3 | 3 | 0 | 0 | | | | | | | | | | | | | | | | | | |
| 2 | 2 | 0 | 1 | | | | | | | | | | 1 | 0 | 0 | 0 | 0 | 0 | 0 | 0 | 0 |
| 1 | MF | 1 | 0 | 1 | 0 | 1 | 1 | 1 | 1 | 0 | 0 | 1 | | | | | | | | | |
| 0 | B | 1 | 0 | 1 | 1 | 1 | 1 | 1 | 1 | 1 | 1 | 0 | | | | | | | | | |

FIG. 10

RAM MAP

| REGISTERS | | |

ELEVATOR SYSTEM

BACKGROUND OF THE INVENTION

1. Field of the Invention:

The invention relates in general to elevator systems, and more specifically to elevator systems which include a visual display for indicating the existence of predetermined calls for elevator service, and the floor associated with each call.

2. Description of the Prior Art:

Elevator systems of the prior art conventionally include push buttons in the hallways of the floors for registering up and down hall calls, and pushbuttons in each elevator car for a passenger to indicate the desired destination floor after the car has stopped to admit the prospective passenger in response to a hall call. A lamp associated with each hall call pushbutton and each car call push button is energized when the associated pushbutton is actuated, to signify that a call has been entered, and the lamp remains energized until the call is answer ed or served. For example, a reset signal may be generated to deenergize the lamp when the elevator car initiates slowdown in its preparation to stop at the floor associated with the call.

Registered up and down hall calls, and/or car calls registered in each car, may also be displayed remotely from the pushbuttons, such as at a traffic director station located in the lobby. A lamp is provided on this display panel for each call to be displayed. The proper lamp is energized when a call is entered, and it is deenergized when the call is answered or served.

SUMMARY OF THE INVENTION

Briefly, the present invention is a new and improved elevator system which includes a new and improved display for displaying calls for elevator service. While in a preferred embodiment of the invention, the display is utilized for displaying up and down hall calls, it may also be used to display car calls, if desired. Instead of requiring a lamp for each call to be displayed, the display includes a limited number of display positions, with the number of display positions being unrelated to the maximum possible number of such calls. In other words, each display position is not permanently associated with any specific floor, but may be used to signify a call at any selected floor by displaying the letters or numbers associated with the selected floor at this position. Each position may be an addressable location on a video monitor, a segmented display device, such as the popular 7-segment LED display, or any other addressable display.

The calls are sequentially displayed in a predetermined order, one at a time, with each call being displayed for a predetermined period of time, such as one second. If the display is associated with car calls, and the display is located within the elevator car, the car calls are preferably presented in the order in which they will be served by the elevator car. If the display is a remote display for hall calls, and/or car calls, the calls are preferably presented in the order in which their associated floors appear in the building. For example, they may be presented in an order which starts with the lowest floor in the building.

In addition to sequentially displaying the calls in a predetermined order, in the preferred embodiment of the invention the total number of such calls in the system at any instant is also displayed. For example, if the display is associated with a traffic director's station there would be at least two display positions for up hall calls, and at least two display positions for down hall calls. Up and down hall calls in the system would each be sequentially displayed, with each display changing periodically to display the next higher hall call. The total number of unanswered up and down hall calls would each be individually displayed on the remaining two display positions. If desired, additional information regarding the calls may be displayed. For example, two additional display positions may be provided for sequentially displaying up and down hall calls which have been registered for longer than a predetermined period of time. This latter display may be continuously operative, or it may be selectively activated by a special switch.

BRIEF DESCRIPTION OF THE DRAWING

The invention may be better understood, and further advantages and uses thereof more readily apparent, when considered in view of the following detailed description of exemplary embodiments, taken with the accompanying drawings in which:

FIG. 2 is a graph which illustrates the information transferred in a data link shown in FIG. 1, between certain control functions of the elevator system and the display function;

FIGS. 8A, 8B, 9A and 9B are flow charts which illustrate the basic steps of programs for sequentially displaying calls on the video monitor shown in FIGS. 1 and 3 through 7; and FIGS. 10, 11 and 12 illustrate ROM and RAM maps useful in understanding the flow charts of FIGS. 8 and 9.

DESCRIPTION OF PREFERRED EMBODIMENTS

Figure 1:
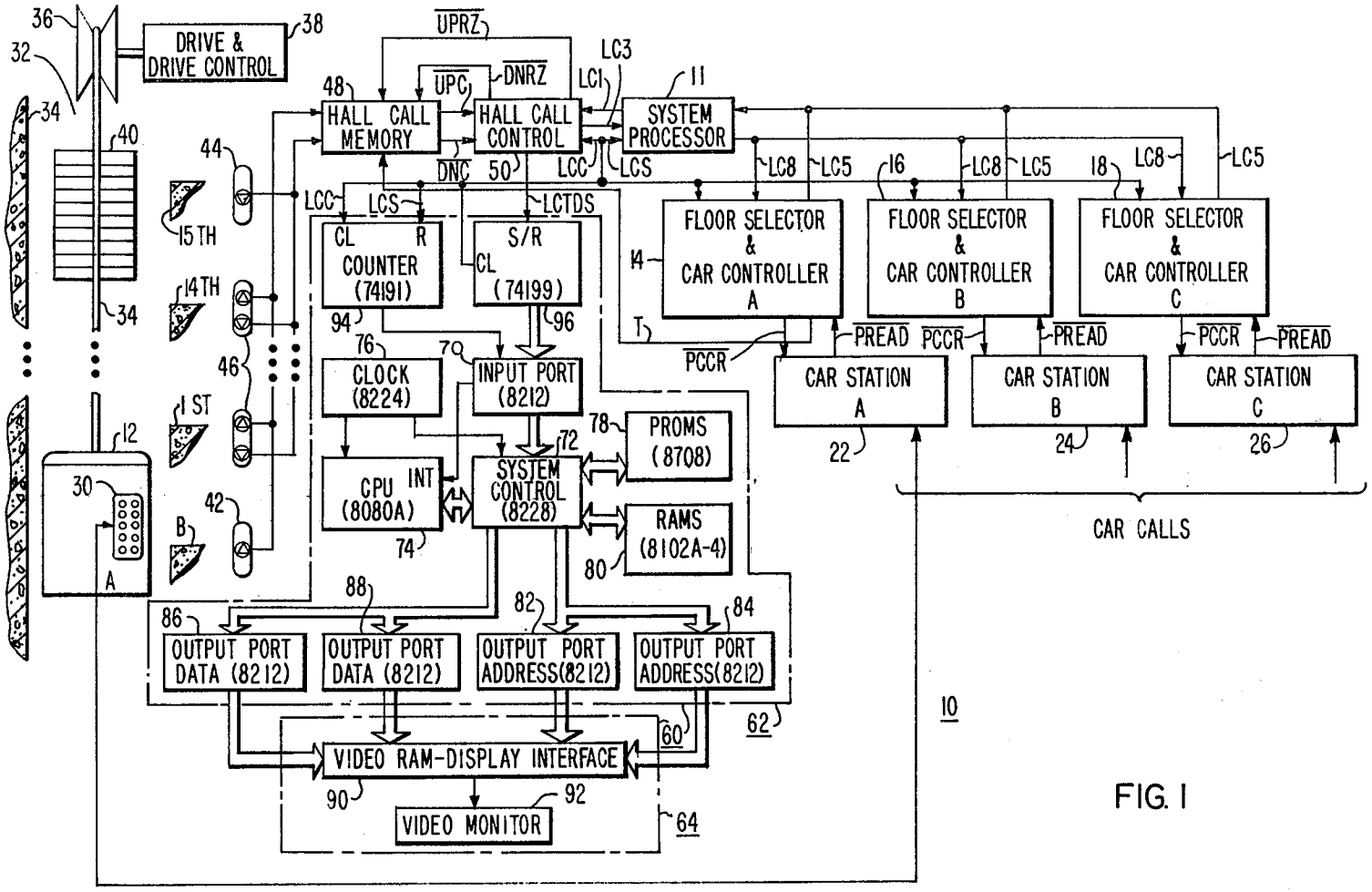
FIG. 1 is a diagrammatic view of an elevator system constructed according to the teachings of the invention.

Referring now to the drawings, and to FIG. 1 in particular, there is shown an elevator system 10 constructed according to the teachings of the invention. In order to limit the complexity of the present application, the following United States patents, which are assigned to the same assignee as the present application, are hereby incorporated by reference. These United States patents describe in detail an elevator system which may utilize the teachings of the invention, and thus FIG. 1 illustrates these functions in block form;

(1) U.S. Pat. No. 3,750,850

(2) U.S. Pat. No. 3,804,209

(3) U.S. Pat. No. 3,851,733

Elevator system 10 includes a plurality of elevator cars under the control of a supervisory system processor 11. For purposes of example, the controls A, B, and C for three elevator cars are illustrated, with only an elevator car 12, which is associated with control A, being illustrated since the others would be similar. The elevator controls A, B and C each include a floor selector and car controller 14, 16 and 18, respectively, mounted remotely from the associated car, such as in the machine room. In addition to the floor selectors, the elevator controls also include car stations 22, 24 and 26 for the three elevator cars. Each of the car stations includes a pushbutton array, such as pushbutton array 30 illustrated in elevator car 12, for passengers to register car calls, i.e., their destination floor. The car calls are serialized in the car station and sent to the associated floor selector as signal $\overline{\text{PREAD}}$. Car call resets are sent from the floor selector to the car station as serial signal $\overline{\text{PCCR}}$.

The elevator cars are mounted for movement in a building to serve the floors therein. For example, car 12 is mounted on a hoistway 32 of a building 34 having a plurality of floors or landings. For purposes of example, it will be assumed that building 34 has 16 floors, with only the lowest floor B, the highest or fifteenth floor, and intermediate first and fourteenth floors, being shown in FIG. 1.

Car 12 is supported by a plurality of wire ropes 34 which are reeved over a traction sheave 36 mounted on the shaft of a drive motor 38. Drive motor 38 also includes suitable controls, shown generally within block 38. A counterweight 40 is connected to the other ends of the ropes 34. A traction elevator system is illustrated in FIG. 1 for purposes of example, but it is to be understood that the invention applies equally to any type of elevator system, such as an elevator system which is hydraulically operated.

Hall cells are registered by pushbuttons mounted in the hallways adjacent to the floor openings to the hoistway. For example, the lowest floor B includes an up pushbutton 42, the fifteenth or uppermost floor includes a down pushbutton 44, and the intermediate floors each include up and down pushbutton assemblies 46. The up and down hall calls registered on these pushbuttons are sent to a hall call memory 48 where they are serialized and sent to hall call control 50 as signals $\overline{\text{UPC}}$ and $\overline{\text{DNC}}$, respectively.

Hall call control 50 sends the hall calls to the system processor as part of serial signal LC3. The system processor 11 prepares assignments for the various elevator cars and sends individual assignment words to each car controller and floor selector via signals LC8. Each car controller and floor selector prepares status words for the system processor 11, which are sent to the system processor as signals LC5. The system processor 11 prepares reset signals for the hall call control and sends the resets to the hall call control as part of a signal LC1. Hall call control sends up and down resets $\overline{\text{UPRZ}}$ and $\overline{\text{DNRZ}}$, respectively, to the hall call memory 48. Clock and synchronization signals LCC and LCS, respectively, are prepared by the system processor 11 and sent to the various control functions, to properly control transfer of data between the functional blocks. The incorporated patents explain the timing and makeup of the various serial signals in detail.

FIG. 1 illustrates an embodiment of the invention in which hall calls registered on pushbuttons 42, 44 and 46 at the various floors are displayed at a selected location, such as at a traffic director station 60, hereinafter referred to as TDS 60, located in the lobby or the main floor. For purposes of example, TDS 60 includes a microprocessor 62 and a video display 64. It is to be understood, however, that the display 64 may be any suitable type of display, such as light emitting diodes (LEDs), liquid crystals, and the like. Further, the processing portion of the display may be hard-wired logic, instead of using a microprocessor. The microprocessor 62 and video display 64 is an attractive combination as it facilitates the use of TDS 60 as a universal message center for the building 34 which may be easily tied into the building security system.

For purposes of example, the microprocessor 62 will be assumed to be Intel's 8080, but any suitable microprocessor or digital computer may be used. Microprocessor 62 includes an input port 70 (Intel's 8212), a system controller 72 (Intel's 8228), a central processor or CPU 74 (Intel's 8080A), a clock generator 76 (Intel's 8224), a read only memory 78, also referred to as ROM 78 (Intel's 8708), a random access memory 80, also referred to as RAM 80 (Intel's 8102A-4), and output ports 82, 84, 86 and 88 (Intel's8212). In the elevator system of the incorporated patents, the data for TDS 60 would be sent over a serial data link, which is referenced LCTDS. This serial data may be demultiplexed eight bits at a time for entry into input port 70 via a counter 94 (Texas Instruments SN 74191) and a shift register 96 (Texas Instruments SN 74199). Counter 94 is reset by a synchronization signals LCS from the system processor 11, and clocked via a clock signal LCC from the system processor. The clock signal LCC also clocks the shift register to clock the serial data contained in signal LCTDS into the eight bit shift register 96. Each time counter 94 reaches a count of 8 it outputs a signal to input port 70 which provides an interrupt signal for CPU 74, to notify the CPU that the input port should be read. The eight bits of input data are then transferred to predetermined addresses in RAM 80. The information in RAM 80 is processed according to a program stored in ROM 78, and the resulting information is stored in RAM 80 until it is ready to be read out to the video display via the output ports 82, 84, 86 and 88. If the program for the microprocessor allows sufficient time, the demultiplexing function may be performed entirely within the microprocessor, in which event the shift register 96 and counter 94 would not be required.

FIG. 2 illustrates a data link map for the data link LCTDS which links hall call control 50 and shift register 96. The data link map illustrates basic timing scan slots vertically along the left-hand side, which scan slots are developed by a scan slot counter output SOS-S6S in the elevator system incorporated by reference. The subdivision of each of the basic scan slots is shown horizontally under the heading, "High Speed Scan Slots".

For purposes of example, it will be assumed that each of the basic scan slots exists for two milliseconds. Each basic scan slot is divided into sixteen high speed scan slots by the high speed scan.

Each floor of the building to be served by the elevator system is assigned to one of the basic scan slots. The number of floors plus the number of scan slots required to identify express zones, and the like, determines how high the scan counter should be programmed to count before resetting to zeroes. For purposes of example, it will be assumed that the data link map is associated with a structure having sixteen floor levels, which includes a basement floor B, and floors numbered 1 through 15. Floor number 1 may also be referenced MF. Thus, the scan counter may be programmed to count from 0 to 15 in binary, before resetting. Each of the floors of the structure is assigned a binary address of the scan counter. When the scan counter is outputting the address of a specific floor, a car call for that specific floor will appear in that basic scan slot. During the same address of the specific floor, the high-speed scan will output a plurality of bits of information relative to this same floor. Thus, when the scan counter output is 01001, scan slot 9, which in the example of FIG. 2 is the binary address of the ninth floor, data concerning the ninth floor is transmitted over both the low speed and high speed time multiplexed links.

Data for TDS 60 may include car status data in certain of the high speed scan slots, such as slots 0 through 5 and 9 through 14, one of the slots may be used to check parity, such as slot 15, and certain of the slots may be used for down hall calls $\overline{DNC}$, up hall calls $\overline{UPC}$, and special calls, such as slots 6, 7 and 8, respectively. Thus, when the basic scan slot 9 exists, a down hall call $\overline{DNC}$ for the ninth floor will appear in the sixth high speed scan slot, and an up hall call $\overline{UPC}$ for the ninth floor will appear in the seventh high speed scan slot. Special calls, such as calls from an inconspicuous riser, may appear in scan slot 8, during the appropriate basic scan slot.

The per car data may include three input data words IW0, IW1 and IW2 prepared by each car controller for transmission to the system processor 11, and an additional data word CTDS. Data words CTDS for cars A, B and C may be sent during basic scan slots 0, 1 and 2. In like manner, the first input data word IW0 from the three cars may be sent during the three basic scan slots 4, 5 and 6. The second input word IW1 would be sent during the next three basic scan slots 8, 9 and 10, and the third input data word IW2 may be sent during the three basic scan slots 12, 13 and 14. The data words are then repeated in the same order.

Figure 3:
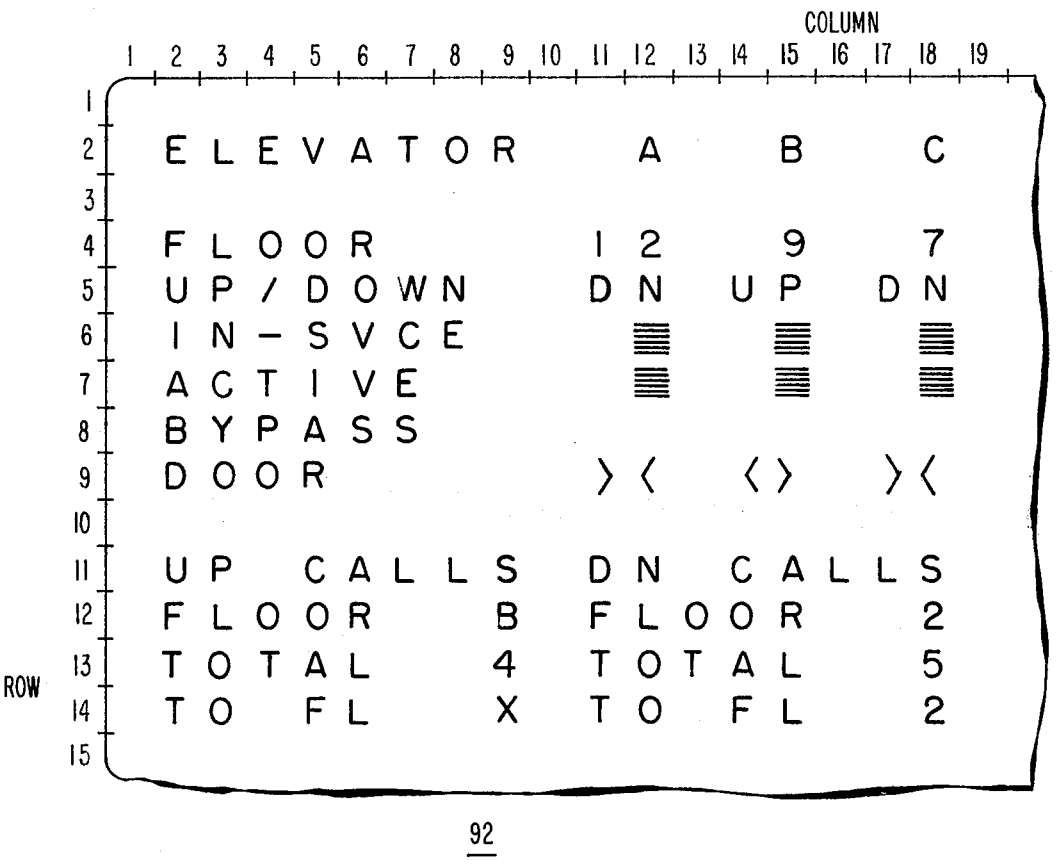
FIG. 3 is an elevational view of a video monitor which may be used in the display shown in block form in FIG. 1, which illustrates the display of hall calls according to an embodiment of the invention.
Figure 4:
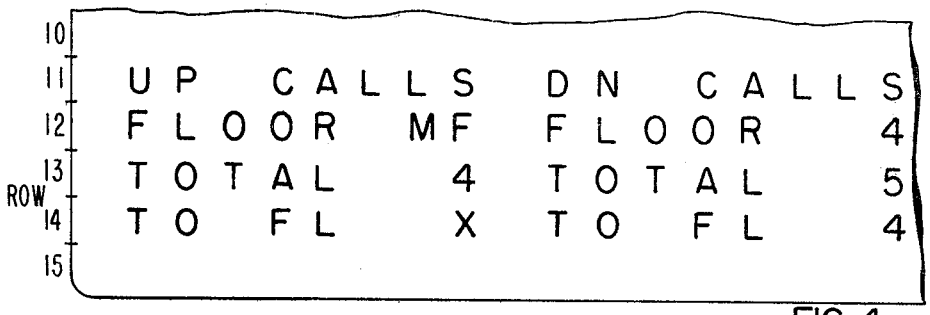
FIGS. 4, 5, 6 and 7 are fragmentary views of the video monitor shown in FIG. 3, illustrating the sequential display aspect of the invention.
Figure 5:
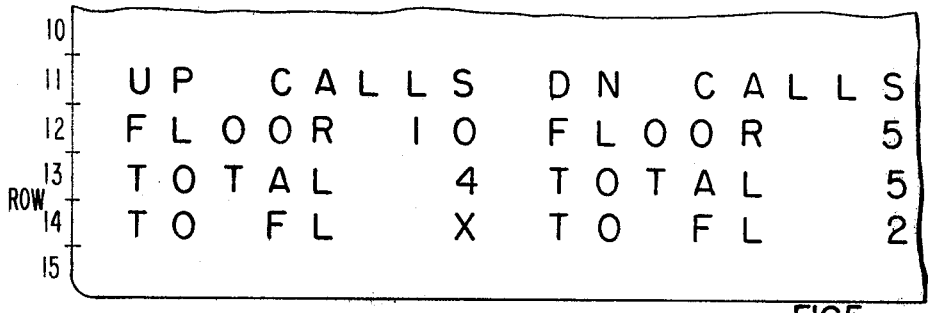
Figure 6:
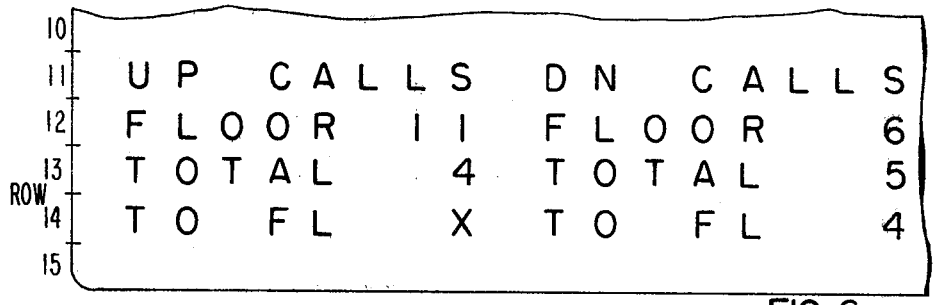
Figure 7:
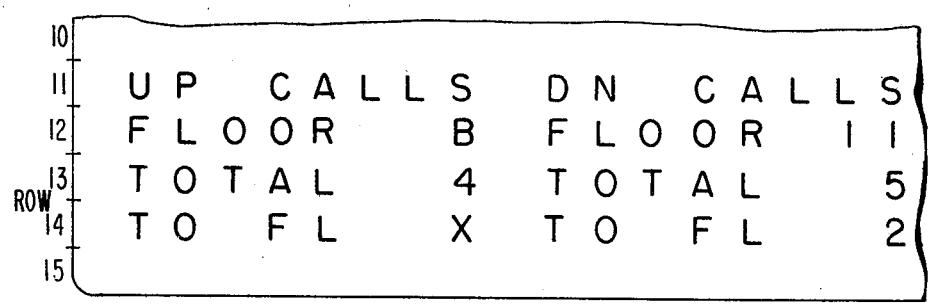

FIG. 1 illustrates TDS 60 with a video display 64 which includes a video RAM-display interface 90 and a video monitor 92. For purposes of example, it will be assumed that the video display interface 90 is the CRT controller MTX-2480, manufactured by MATROX Electronic Systems of Montreal, Quebec. The video monitor may be Model EVM-1410, manufactured by Electrohome Ltd., Kitchener, Ontario. The MTX-2480 has a 24×80 display field for displaying eighty columns and twenty-four rows of ASCII font characters. The display screen organization is illustrated in FIG. 3, with the characters set forth thereon illustrating a first embodiment of the invention. Representative per car data for three cars A, B and C is illustrated, as well as the total number of registered up and down hall calls.

Typical per car data may include the floor position of each car, the car travel direction, an inservice signal, an activity signal which indicates whether or not the car is active or available, a bypass signal which indicates whether or not the car is bypassing hall calls, and a car door signal which indicates whether or not the car doors are open or closed.

The up and down hall calls are developed from signals $\overline{UPC}$ and $\overline{DNC}$, respectively. Unlike conventional call displays, a hall call for a specific floor is not tied to a location on the device or display which is unique only to that particular floor. The display may thus be standardized. The present invention sequentially displays the currently existing up and down hall calls in a predetermined order, and it displays the total number of up and down hall calls. Timed out calls, i.e., those which have been registered for a predetermined period of time, may also be sequentially displayed. Thus, the number of hall calls may be determined at a glance, and the locations of the hall calls may be determined in a few seconds, as the sequential function changes the display of hall calls at predetermined regular intervals, such as every second. The top and down hall calls are presented in a predetermined order, related to the relative positions of the hall calls in the building. Preferably, they are presented in an order starting with the lowest hall call in the building, and proceeding upwardly through the highest hall call.

FIGS. 3 through 7 illustrate the sequential aspect of the invention. For purposes of example, it will be assumed that there are four up hall calls and five down hall calls in the system, and that two of the down hall calls have been registered for more than a predetermined period of time, such as three minutes. The legends "up calls" and "down calls" appear in row 11 of the video monitor 92, the legends "floor" appear in row 12 directly under the up down hall call legends, and the legends "total" appear in row 13 directly under the legends "floor", and the legends TO FL appear in row 14, directly under the legends "total". Columns 8 and 9 of row 12 sequentially present the floor numbers which have registered up hall calls, and columns 17 and 18 sequentially present the floor numbers which have registered down hall calls. Columns 8 and 9 of row 13 continuously present the total number of up hall calls in the system. This number will be updated at predetermined short intervals, to account for new up hall calls, and answered up hall calls. Columns 17 and 18 of row 13 continuously present the total number of down hall calls in the system. This number will also be updated at predetermined short intervals, to account for new down hall calls, and answered down hall calls.

The legent TO FL indicates time out hall calls. These legends may be arranged to only appear when a separate enabling switch is actuated. When such a switch is actuated, the legends TO FL appear and columns 8 and 9 sequentially present the floor numbers of up hall calls registered for the predetermined period of time. In like manner, columns 17 and 18 sequentially present the floor number of down hall calls registered for the predetermined period of time.

With the example hereinbefore set forth, it will be assumed that the four up hall calls are associated with the basement floor B, the main floor MF, and floors 10 and 11. It will further be assumed that the five down hall calls are associated with the second, the fourth, the fifth, the sixth and eleventh floors, and that the down hall calls from the second and fourth floors are timed out. FIGS. 3 through 7 indicate the condition of video monitor 92 at predetermined short intervals, such as 1 second intervals. Under the legent "up calls", adjacent to the legend "floor", the four up hall calls will be sequentially displayed as B, MF, 10 and 11 in FIGS. 3, 4, 5 and 6, respectively. The up call from the basement B will again be displayed in FIG. 7, etc. Since there are four up hall calls, the number "4" will appear adjacent to the legend "total", under the legend "up calls". If the timed out call feature is activated, an "X", or some other symbol indicating that there are no timed out up hall calls, will appear adjacent to the legent "TO FL" under the legent "up calls".

In like manner, under the legent "DN calls", adjacent to the legend "floor", the five down hall calls will be sequentially displayed as 2, 4, 5, 6 and 11 in FIGS. 3, 4, 5, 6 and 7, respectively. The five down hall calls will then be sequentially repeated, one second apart.

As new hall calls are registered, they are added to the sequentially presented list in the proper location relative to the other hall calls, and as hall calls are answered or served by an elevator car, they are deleted from the sequentially presented list.

The video monitor 92 has space for displaying information for additional cars. Further, the video monitor may be tied into the building security system, with a space on the display being maintained for displaying various building messages.

FIGS. 8A, 8B, 9A and 9B are flow charts, which along with the ROM and RAM maps of FIGS. 10, 11 and 12, will enable one skilled in the art to program a digital computer, such as Intel's 8080 microprocessor, to implement the teachings of the invention. The program has been divided into two parts in order to illustrate that the timed out feature is optional. The program for the timed out features is set forth in FIGS. 9A and 9B. The program developed from the flow charts would be loaded into the ROM 78 shown in FIG. 1. From the following description, it will also be apparent to one skilled in the art how hall calls and/or car calls may be sequentially displayed on segmented type alphanumeric displays, such as LEDs, and liquid crystal displays.

Figure 8A:
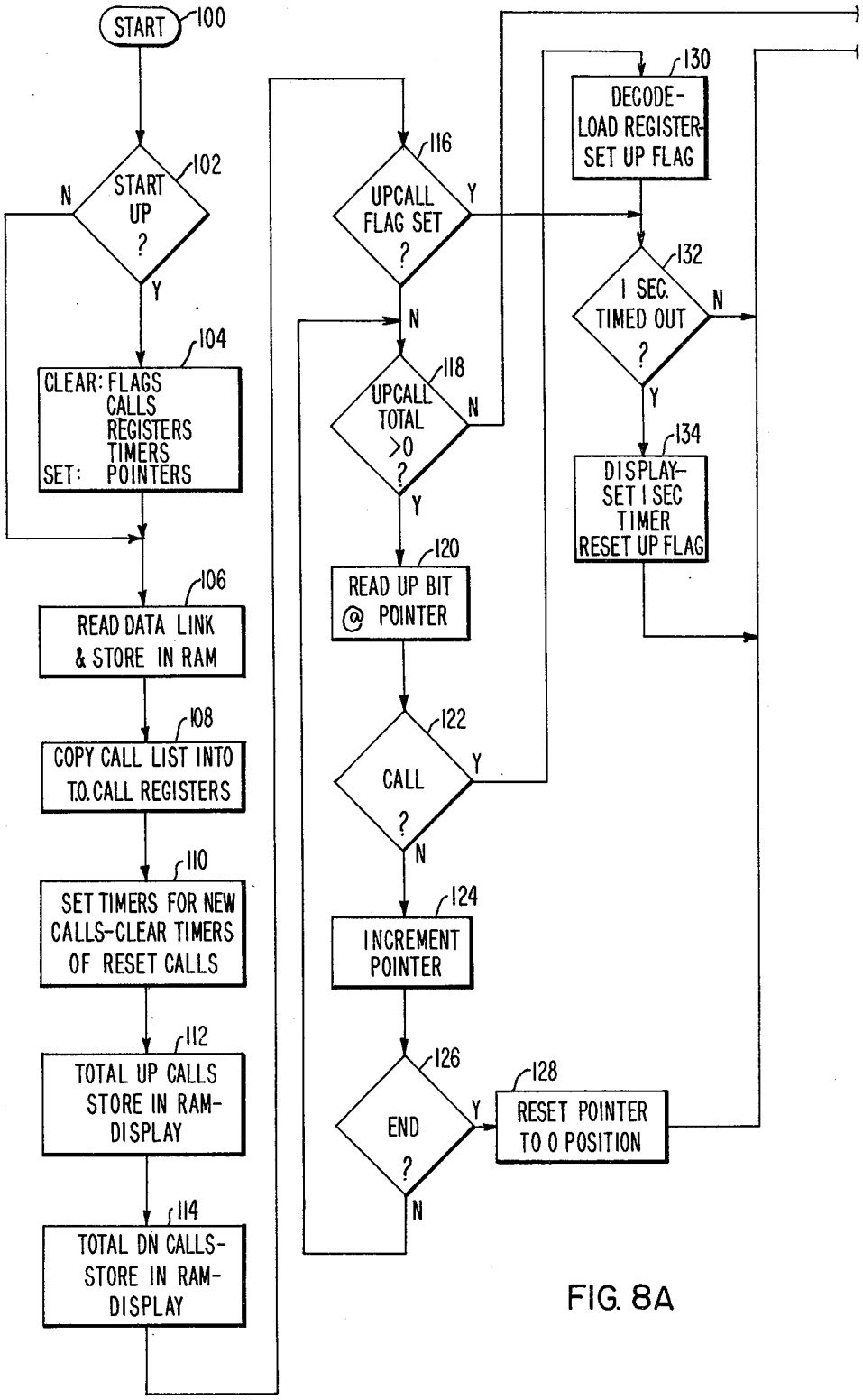
Figure 8B:
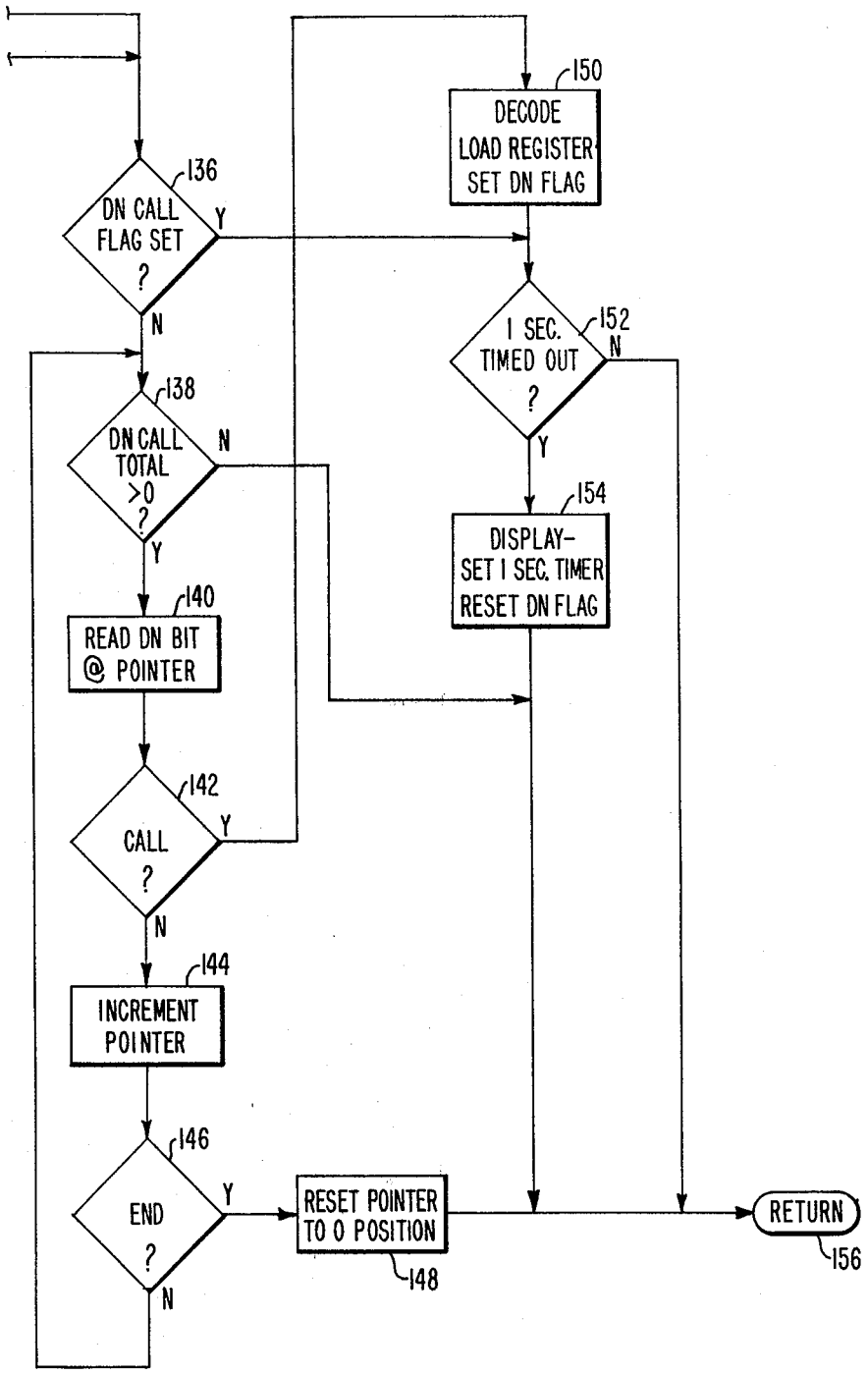

Referring now to FIGS. 8A and 8B, there is shown a flow chart for implementing the sequentially displayed up and down hall calls, as well as the total number of up and down hall calls, as set forth in the video monitor 92 of FIG. 3. When the data from the hall call control 50 shown in FIG. 1 is going to be transmitted to TDS 60 via data link LCTDS, a synchronization signal from the system processor will alert CPU 74 and the program of FIGS. 8A and 8B will be entered at input 100. Step 102 determines if this is the initial start-up, such as at the start of a day, or a start-up following power shutdown or failure. If it is one of the initializing conditions, step 104 initializes the program by clearing all calls, flags, timers, and registers, and by setting the addresses of the stack pointers to the start of the various stacks utilized in the memory. Step 106 then reads the data link LCTDS and stores it in RAM 80. If the program is not to be initialized, step 104 is skipped, with the program going directly from step 102 to step 106.

When the contents of data link LCTDS are written into RAM 80, the up and down hall calls $\overline{UPC}$ and $\overline{DNC}$, respectively, are stored at predetermined addresses in this memory. FIG. 10 illustrates a look-up table stored in ROM 78 which relates the basic scan slot floors to floor levels, with the ROM map for this look-up table being displayed side-by-side with a RAM map illustrating the storage of up and down hall calls. As hereinbefore stated, the information in data link LCTDS may be serially directed through input port 70, or it may be clocked through eight bits at a time, depending upon how long it is desired to tie up the microprocessor on input data transfer.

The serial format of the up and down hall calls $\overline{UPC}$ and $\overline{DNC}$ automatically presents the calls in an ordered format, and thus the calls do not have to be sorted by an ordering routine. If the elevator system would be of the type in which the cells are presented in a random order, the program would also include an ordering routine in order to present the calls in the desired format.

The storage of the up down hall calls $\overline{UPC}$ and $\overline{DNC}$ starts at a predetermined address in RAM 80 and the address is automatically sequentially incremented for each scan slot.

FIG. 10 illustrates the up and down hall calls of the example set forth in FIGS. 3 through 7, with logic one bits being entered at the locations of the hall calls.

Figure 9B:
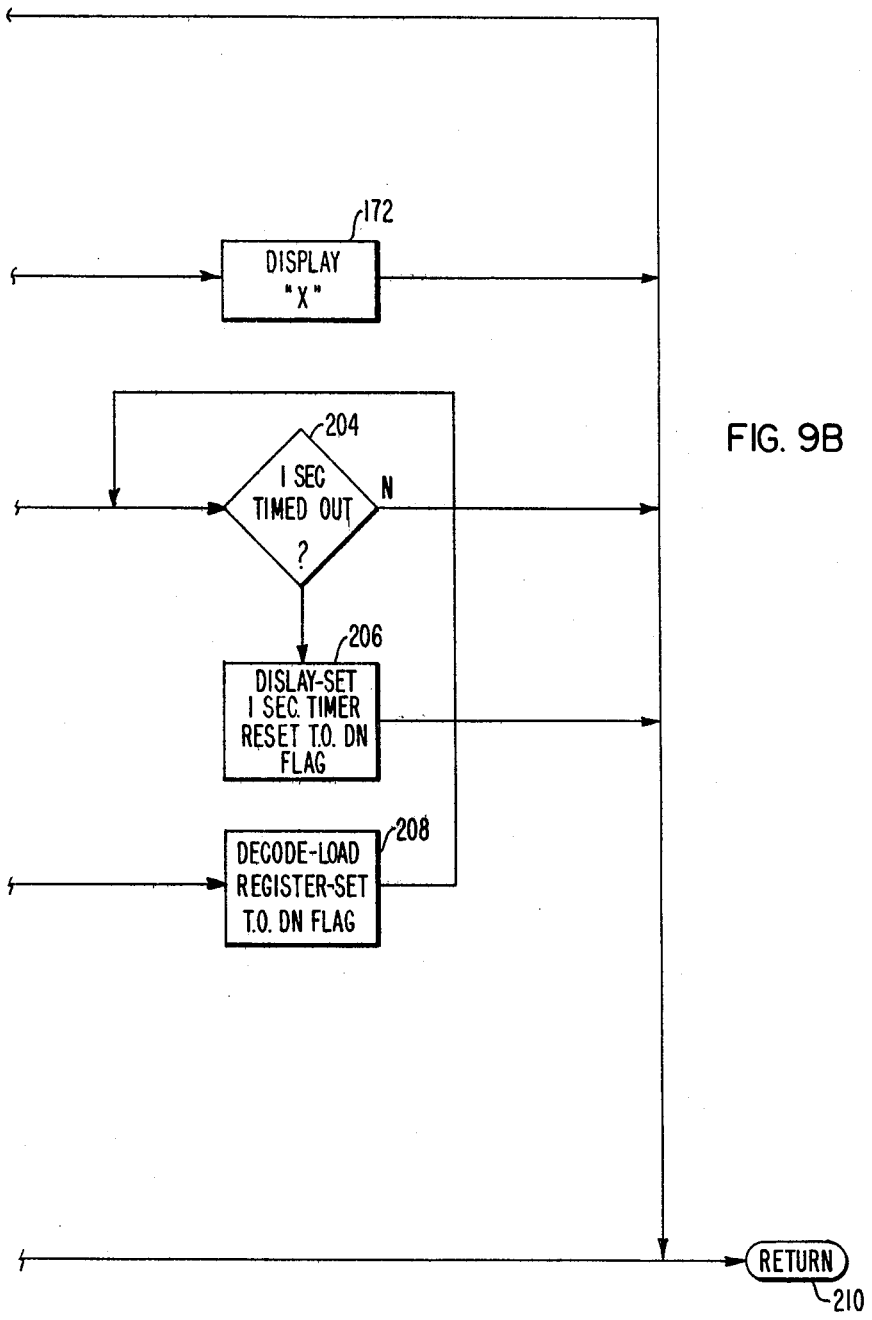

If the halls calls are to be timed, such as required for implementing the timed out call program shown in FIG. 9, step 108 copies the up and down hall call list shown in FIG. 10 under the heading "hall calls" into a software or memory stack. Step 110 starts a timer associated with each new call, and clears the timers associated with reset or answered hall calls. A convenient software timer may initially set the timer word to a predetermined value, such as all "ones", and the activated timers are periodically decremented in response to the system clock. When the timer reaches all zeros, the call is "timed out". If the timed out feature of FIGS. 9A and 9B is not desired, steps 108 and 110 would be omitted.

Step 112 counts the number of up hall calls in the stack, and the number is decoded to ASCII font characters via another look-up table in ROM 78. The decoded information is stored in RAM 80, such as illustrated in FIG. 12 under the heading "total up call register". The monitor addresses for the left and right-hand bits are listed in FIG. 12, and the data to be displayed at each bit location is also set forth. The left-hand bit, for example, is to be displayed in row 13, column 8, and since the total number of calls does not include a left-hand digit, the ASCII representation for a blank is 010 for the row and 0000 for the column, and thus the left-hand bit data would include these representations. The right-hand bit is to be displayed in row 13 at column 9, with the address for this bit being set forth in FIG. 12. The ASCII representation for a "four" is 011 for the row and 0100 for the column, with these binary representations being set forth in FIG. 12 under the heading "Monitor Data-Right Bit".

In like manner, step 114 totals the down hall calls, it translates the resulting number into ASCII representation, and it stores the translation in the total down call register shown in FIG. 12.

Step 116 checks the flag register in RAM 80, shown in FIG. 11, to determine if an up call flag has been set. The up call flag bit is set to a logic one in order to indicate that the next up hall call to be displayed has been selected and is stored in the "up call ready register" in RAM 80 shown in FIG. 12. When the one second display time expires for the current display, the contents of the up call ready register are displayed and the up call flag is reset. It will be assumed that the up call flag is not set, and step 118 checks to see if the up call total is greater than 0. If there are no registered up calls, the up call portion of the program need not be followed. It will be assumed that there is at least one up hall call registered, and step 118 will proceed to step 120 which reads the up bit in the up hall call stack shown in FIG. 10, at the location of the stack pointer. It will be assumed that the stack pointer address has been reset to the bottom of the stack, i.e., at the lowest floor position of the building. Step 122 checks to see if there is an up call at this location. If not, step 124 increments the stack pointer, step 126 checks to see if the end of the stack has been reached, i.e., the stack address associated with the uppermost floor of the building, and if it has not, the program returns to step 118. If step 126 finds the top of the stack has been reached, step 128 resets the stack pointer address to the lowest stack position and the program proceeds to look for down hall calls.

If step 122 finds on up hall call, step 130 decodes the bit location into an ASCII from number representation in an appropriate look-up table, it loads the up call ready register in FIG. 12, and it sets the up call flag in FIG. 11. Step 132 checks to see if the 1 second display time for the current display has expired. If it has expired, step 134 displays the contents of the up call ready register, it sets a 1 second timer, such as represented by the display timer bits shown in FIG. 11, and it resets the up call flag. The display timer bit is a logic one until it times out, and then it goes to a logic zero.

If step 116 had found that the up call flag had been set, the program would have proceeded directly to step 132.

The program then proceeds to step 136 to look for a down hall call. If step 118 had found that there were no up hall calls registered, step 118 would have proceeded directly to step 136. If step 132 finds that the 1 second display time for the currently displayed floor number has not expired, step 132 would also proceed directly to step 136.

Steps 136 through 154 are similar to those described relative to steps 116 through 134 for up hall calls, and thus need not be described in detail. The program then exits at 156.

If the timed out call option is used, the flow chart shown in FIGS. 9A and 9B may be utilized to implement this function. This program is entered at 160 and step 162 checks the special switch to determine if the timed out call display function should be operative. If not, step 164 "kills" the timed out call display, and the program returns to the main program at 210.

If step 162 finds that the timed out call switch has activated this portion of the program, step 166 checks the registered up calls in the stack shown in FIG. 10 for an expired timer. If there are none, step 168 displays an "X", or other suitable symbol, to indicate that there are no timed out up calls. Step 170 checks for timed out down calls, and if there are none, step 172 initiates the display of an "X" on the video monitor 92, and the program exits at 210.

If step 166 finds an expired timer for a currently registered up hall call, step 174 checks to see if the timed out up hall call flag shown in FIG. 11 is set. It it is not set, there is no up hall call floor ready to be displayed, and steps 176, 178, 180 and 182 read the timed hall call stack, one bit at a time, similar to the process hereinbefore described relative to steps 120 through 128. When the top address of the stack is reached, step 184 resets the stack pointer and proceeds to step 170.

If step 178 finds a timed out hall call, step 190 decodes the bit position to provide an ASCII representation, it loads the timed out up call register in FIG. 12, and it sets the timed out up flag in FIG. 11. Step 190 then proceeds to step 186. If step 174 found that the timed out up call flag is set, it would proceed directly to step 186.

Step 186 checks to see if the 1 second display time has expired. If it has expired, step 188 displays the contents of the timed out up call ready register shown in FIG. 12, and it proceeds to step 170. If the 1 second time has not expired, step 186 proceeds directly to step 170.

Steps 192 through 208 check for a timed out down call, similar to steps 174 through 190 for timed out up calls, and thus need not be described in detail.

While the invention has been described primarily relative to the display of up and down hall calls, it is to be understood that registered car calls may be sequentially displayed for each elevator car, if desired.

In summary, there has been disclosed a new and improved elevator system, and a new and improved call display arrangement for an elevator system in which the display function is separate from the call entering function. The calls are sequentially displayed in a predetermined order on a display which may be standardized and relatively small in size, since the display positions are unrelated to floor positions, and since all of the registered up and down hall calls may be displayed using only two display positions. The total number of registered calls are also displayed, requiring only two additional display positions to display these totals. Timed out up and down hall calls may also be sequentially displayed, if desired, requiring only two additional display positions in order to cycle through the up and down timed out hall calls.

We claim as our invention:

1. An elevator system, comprising:
   - a building having a plurality of floors and hoistway means,
   - an elevator car mounted in the hoistway means of said building to serve the floors therein,
   - call means for registering calls for elevator service,
   - memory means for storing registered calls,
   - control means directing said elevator car to serve registered calls for elevator service,
   - means removing registered calls from said memory means when said elevator car serves a call for elevator service,
   - and display means,
   - said display means including signal preparation means which provides output signals responsive to the registered calls stored in said memory means,
   - said display means further including visual means responsive to the output signals from said signal preparation means for visually displaying at least certain of the registered calls stored in said memory means one at a time, in a predetermined timed sequence, at a first common display location, such that each call in the predetermined sequence is displayed at the same location as the previous call in the sequence.

2. The elevator system of claim 1 wherein the call means includes a plurality of pushbuttons located at the floors of the building for registering up and down hall calls, and the at least certain of the registered calls which are visually displayed at the first common display location are up hall calls, and wherein the visual means also visually displays the registered down hall calls one at a time, in a predetermined timed sequence, at a second common display location, such that each down hall call in the predetermined sequence is displayed at the same location as the previous down hall call in the sequence.

3. The elevator system of claim 2 wherein the predetermined time sequences in which the up and down hall calls are displayed at the first and second common display locations, respectively, are related to the relative locations of the floors associated with the up and down hall calls.

4. The elevator system of claim 2 wherein the display means includes means for providing first and second sum signals responsive to the total number of registered up and down hall calls, respectively, in the memory at any instant, with the visual means being responsive to said first and second sum signals for visually displaying the total number of up and down hall calls in the memory means at any instant.

5. The elevator system of claim 2 including means for timing each registered up and down hall call stored in the memory means, and wherein the display means includes means providing timed out output signals responsive to registered up and down hall calls which have been registered for a predetermined period of time, with the visual means being reponsive to said timed out output signals for visually displaying the up and down hall calls which have been registered for a predetermined period of time one at a time, in predetermined timed sequences, at first and second common display locations, respectively, such that the timed out up hall calls sequentially appear at the first common display location, and the timed out down hall calls sequentially appear at the second common display location.

6. The elevator system of claim 1 wherein the display means includes means for providing a sum signal responsive to the total number of the at least certain of the registered calls stored in the memory means at any instant, with the visual means being responsive to said sum signal for visually displaying the total number of such registered calls at any instant.

* * * * *